US010895151B2

(12) United States Patent
Donald et al.

(10) Patent No.: US 10,895,151 B2
(45) Date of Patent: Jan. 19, 2021

(54) APPARATUS, SYSTEMS AND METHODS FOR OIL AND GAS OPERATIONS

(71) Applicant: Enpro Subsea Limited, Aberdeen (GB)

(72) Inventors: Ian Donald, Aberdeenshire (GB); John Reid, Perthshire (GB)

(73) Assignee: Enpro Subsea Limited, Aberdeen (GB)

( * ) Notice: Subject to any disclaimer, the term of this patent is extended or adjusted under 35 U.S.C. 154(b) by 55 days.

(21) Appl. No.: 15/566,644

(22) PCT Filed: Apr. 13, 2016

(86) PCT No.: PCT/GB2016/051036
§ 371 (c)(1),
(2) Date: Oct. 13, 2017

(87) PCT Pub. No.: WO2016/166534
PCT Pub. Date: Oct. 20, 2016

(65) Prior Publication Data

US 2018/0112527 A1 Apr. 26, 2018

(30) Foreign Application Priority Data

Apr. 13, 2015 (GB) ..... 1506266.4

(51) Int. Cl.
*E21B 34/04* (2006.01)
*E21B 49/08* (2006.01)
*E21B 33/076* (2006.01)

(52) U.S. Cl.
CPC ..... *E21B 49/086* (2013.01); *E21B 33/076* (2013.01); *E21B 34/04* (2013.01); *E21B 49/08* (2013.01)

(58) Field of Classification Search
None
See application file for complete search history.

(56) References Cited

U.S. PATENT DOCUMENTS 9,702,249 B2 * 7/2017 Gordon ..... E21B 49/088
10,174,575 B2 * 1/2019 Donald ..... E21B 33/076
(Continued)

FOREIGN PATENT DOCUMENTS

EP 2447588 A2 5/2012
GB 2377425 A 1/2003
(Continued)

OTHER PUBLICATIONS

Donald, et al., "Using Mars (Multiple Application Re-injection System) Technology for Improving Oil Recovery and Reducing Production Risk," SPE 132274,CPS/SPE International Oil & Gas Conference and Exhibition, Beijing, China, Jun. 8-10, 2010, 12 pages.

(Continued)

*Primary Examiner* — Matthew R Buck
*Assistant Examiner* — Douglas S Wood
(74) *Attorney, Agent, or Firm* — Perkins Coie LLP

(57) ABSTRACT

A valve apparatus (400) for a flow system in a subsea oil and gas production installation and a method of use. The valve apparatus comprises an inlet for production flow from the subsea oil and gas production installation, an outlet for production flow, and a flow control valve (420) disposed between the inlet and the outlet. A first flow line (361) in communication with a sampling circuit is disposed between the inlet and the flow control valve, and a second flow line (362) in communication with a sampling circuit is disposed between the outlet and the flow control valve. The flow control valve is operable to be partially closed to create a pressure differential between the first and second flow lines, and thereby drive a production fluid into the sampling circuit.

9 Claims, 11 Drawing Sheets

(56) References Cited

U.S. PATENT DOCUMENTS

| | | | |
|---|---|---|---|
| 2002/0041832 | A1 | 4/2002 | Duriez et al. |
| 2010/0059221 | A1 | 3/2010 | Vannuffelen et al. |
| 2012/0111571 | A1 | 5/2012 | Eriksen |
| 2013/0025854 | A1 | 1/2013 | Theron et al. |
| 2013/0025874 | A1 | 1/2013 | Saunders et al. |
| 2015/0027730 | A1 | 1/2015 | Hall et al. |

FOREIGN PATENT DOCUMENTS

| | | | |
|---|---|---|---|
| WO | 0070185 | A1 | 11/2000 |
| WO | 2005047646 | A1 | 5/2005 |
| WO | 2005083228 | A1 | 9/2005 |
| WO | 2012107727 | A2 | 8/2012 |
| WO | 2013121212 | A2 | 8/2013 |
| WO | 2013160687 | A2 | 10/2013 |
| WO | 2016097717 | A2 | 6/2016 |

OTHER PUBLICATIONS

International Search Report and Written Opinion dated Jul. 28, 2016 in International App. PCT/GB2016/051036.

* cited by examiner

APPARATUS, SYSTEMS AND METHODS FOR OIL AND GAS OPERATIONS

The present invention relates to apparatus, systems and methods for oil and gas operations, in particular to apparatus, systems and methods for fluid intervention in oil and gas production or injection systems. The invention has particular application to subsea oil and gas operations, and aspects of the invention relate specifically to sampling apparatus, systems and methods for fluid intervention in subsea oil and gas production and injection infrastructure.

BACKGROUND TO THE INVENTION

In the field of oil and gas exploration and production, it is common to install an assembly of valves, spools and fittings on a wellhead for the control of fluid flow into or out of the well. A Christmas tree is a type of fluid manifold used in the oil and gas industry in surface well and subsea well configurations and have a wide range of functions, including chemical injection, well intervention, pressure relief and well monitoring. Christmas trees are also used to control the injection of water or other fluids into a wellbore to control production from the reservoir.

There are a number of reasons why it is desirable to access a flow system in an oil and gas production system. In the context of this specification, the term "fluid intervention" is used to encapsulate any method which accesses a flow line, manifold or tubing in an oil and gas production, injection or transportation system. This includes (but is not limited to) accessing a flow system for fluid sampling, fluid diversion, fluid recovery, fluid injection, fluid circulation, fluid measurement and/or fluid metering. This can be distinguished from full well intervention operations, which generally provide full (or near full) access to the wellbore. Full well intervention processes and applications are often technically complex, time-consuming and have a different cost profile to fluid intervention operations. It will be apparent from the following description that the present invention has application to full well intervention operations. However, it is an advantage of the invention that full well intervention may be avoided, and therefore preferred embodiments of the invention provide methods and apparatus for fluid intervention which do not require full well intervention processes.

International patent application numbers WO00/70185, WO2005/047646, and WO2005/083228 describe a number of configurations for accessing a hydrocarbon well via a choke body on a Christmas tree.

Although a choke body provides a convenient access point in some applications, the methods of WO00/70185, WO2005/047646, and WO2005/083228 do have a number of disadvantages. Firstly, a Christmas tree is a complex and carefully-designed piece of equipment. The choke performs an important function in production or injection processes, and its location on the Christmas tree is selected to be optimal for its intended operation. Where the choke is removed from the choke body, as proposed in the prior art, the choke must be repositioned elsewhere in the flow system to maintain its functionality. This compromises the original design of the Christmas tree, as it requires the choke to be located in a sub-optimal position.

Secondly, a choke body on a Christmas tree is typically not designed to support dynamic and/or static loads imparted by intervention equipment and processes. Typical loads on a choke body in normal use would be of the order of 0.5 to 1 tonnes, and the Christmas tree is engineered with this in mind. In comparison, a typical flow metering system as contemplated in the prior art may have a weight of the order of 2 to 3 tonnes, and the dynamic loads may be more than three times that value. Mounting a metering system (or other fluid intervention equipment) on the choke body therefore exposes that part of the Christmas tree to loads in excess of those that it is designed to withstand, creating a risk of damage to the structure. This problem may be exacerbated in deepwater applications, where even greater loads may be experienced due to thicker and/or stiffer components used in the subsea infrastructure.

In addition to the load restrictions identified above, positioning the flow intervention equipment on the choke body may limit the access available to large items of process equipment and/or access of divers or remotely operated vehicles (ROVs) to the process equipment or other parts of the tree.

Furthermore, modifying the Christmas tree so that the chokes are in non-standard positions is generally undesirable. It is preferable for divers and/or ROV operators to be completely familiar with the configuration of components on the Christmas tree, and deviations in the location of critical components are preferably avoided.

Another drawback of the prior art proposals is that not all Christmas trees have chokes integrated with the system; approaches which rely on Christmas tree choke body access to the flow system are not applicable to these types of tree.

WO2013/121212 describes an apparatus and system for accessing a flow system such as a subsea tree, which addresses drawbacks of choke-mounted flow access, by providing a flow access apparatus which can be used at a variety of access points away from the choke and optionally away from the subsea tree. The apparatus and methods of WO2013/121212 enable a range of fluid intervention operations, including fluid sampling, fluid diversion, fluid recovery, fluid injection, fluid circulation, fluid measurement and/or fluid metering.

When a sampling hydrocarbons during production operations, there are various technical challenges associated with obtaining a representative sample of hydrocarbons from the production flow.

It is known to use a Venturi device to creates a pressure differential to cause fluid to be driven through a sampling circuit and into sampling chambers. However, Venturi devices in this application are sensitive to production flow. During the production cycle, production flow varies according to the production curve, which causes the performance of the Venturi to vary. If the Venturi is configured to operate at a peak production rate, then as the production rate drops, there may be insufficient pressure to drive the sampling circuit. Conversely, if the Venturi is configured to operate at a reduced production rate, during periods of peak production, the sampling circuit may be overdriven, resulting in poor collection parameters and prevent representative samples from being collected.

It has also been proposed to use differential pressure, for example, across a choke of a subsea tree, to drive a sampling circuit. However, differential pressures which are too high may result in freezing of the pipework and other flow system components.

SUMMARY OF THE INVENTION

It is amongst the objects of the invention to address the drawbacks and deficiencies of the prior art sampling methods and apparatus.

It is amongst the aims and objects of the invention to provide a method and/or apparatus for driving a subsea sampling circuit in a hydrocarbon production system.

An aim of at least one aspect of the invention is to provide an improved sampling apparatus for oil and gas operations and methods of use. Other aims and objects of the invention include providing an improved sampling test circuit, sampling tools, and/or methods for fluid intervention which are improved with respect to sampling apparatus and method of the prior art. A further aim of at least one aspect of the invention is to provide a sampling apparatus and method of use which facilitates the use of novel flow system access methods and fluid intervention operations.

Further aims and aspects of the invention will become apparent from the following description.

According to a first aspect of the invention there is provided a valve apparatus for a flow system in a subsea oil and gas production installation, the valve apparatus comprising:

an inlet for production flow from the subsea oil and gas production installation;

an outlet for production flow;

a flow control valve disposed between the inlet and the outlet;

a first flow line in communication with a sampling circuit, the first flow line disposed between the inlet and the flow control valve;

a second flow line in communication with a sampling circuit, the second flow line disposed between the outlet and the flow control valve;

wherein the flow control valve is operable to be partially closed to create a pressure differential between the first and second flow lines, and thereby drive a production fluid into the sampling circuit.

According to a second aspect of the invention there is provided a valve apparatus for a flow system in a subsea oil and gas production installation, the valve apparatus comprising:

an inlet for production flow from the subsea oil and gas production installation;

an outlet for production flow;

a flow control valve disposed between the inlet and the outlet;

a first flow line in communication with a sampling circuit, the first flow line disposed between the inlet and the flow control valve;

a second flow line in communication with a sampling circuit, the second flow line disposed between the outlet and the flow control valve;

wherein the flow control valve is operable to drive a production fluid into the sampling circuit.

The valve apparatus may be configured to be coupled into a production flowline located downstream of a subsea tree.

Alternatively, the valve apparatus may be configured to be directly mounted on the subsea tree. The valve apparatus may be a modified subsea valve, and may be modified valve of a subsea tree.

The valve apparatus may be integrated into a metering apparatus, which may be a flowmeter module.

The flow control valve may be operable to be partially closed to create a pressure differential between the first and second flow lines, and thereby drive a production fluid into the sampling circuit.

Alternatively, or in addition, the sampling circuit may be contained within a sampling apparatus and the valve apparatus may be integrated into the sampling apparatus.

The flow control valve may be a first flow control valve, and the sampling apparatus may comprise a second flow control valve. The second flow control valve may be disposed in the sampling circuit, and/or the first and/or second flow lines to the sampling circuit. Preferably, the second flow control valve is operable to regulate the flow of fluid through the sampling circuit, which may therefore regulate the flow of fluid into the sampling circuit. The second flow control valve may be operable to choke the flow in the sampling circuit. Preferably, the second flow control valve is operable to be partially closed to regulate the flow of fluid through the sampling circuit. The sampling apparatus may also comprise a further flow control valve which is operable to be partially closed to regulate the flow of fluid through the sampling circuit. In one embodiment, the second flow control valve is disposed in an inlet flow line to the sampling circuit. Alternatively, the second flow control valve and/or a further flow control valve is disposed in an outlet flow line from the sampling circuit.

Embodiments of the second aspect of the invention may include one or more features of the first aspect of the invention or its embodiments, or vice versa.

According to a third aspect of the invention there is provided a flowmeter apparatus for a flow system in a subsea oil and gas production installation, the flowmeter apparatus comprising:

an inlet for production flow from the subsea oil and gas production installation;

an outlet for the production flow;

a flow control valve disposed between the inlet and the outlet;

a first flow line in communication with a sampling circuit, the first flow line disposed between the inlet and the flow control valve;

a second flow line in communication with a sampling circuit, the second flow line disposed between the outlet and the flow control valve;

wherein the flow control valve is operable to drive a production fluid into the sampling circuit.

The flow control valve may be operable to be partially closed to create a pressure differential between the first and second flow lines, and thereby drive a production fluid into the sampling circuit.

Embodiments of the third aspect of the invention may include one or more features of the first or second aspects of the invention or their embodiments, or vice versa.

According to a fourth aspect of the invention, there is provided a method of sampling fluid from a flow system in a subsea oil and gas installation, the method comprising:

providing a sampling circuit;

providing a valve apparatus comprising:

an inlet for production flow from the subsea oil and gas production installation, an outlet for production flow;

first and second flow lines in communication with the sampling circuit; and a flow control valve;

using the flow control valve of the valve apparatus to drive a production fluid into the sampling circuit.

The method may comprise partially closing the flow control valve to create a pressure differential between the first and second flow lines, and thereby drive a production fluid into the sampling circuit.

The method may comprise collecting fluid in one or more sampling bottles or vessels.

The method may comprise removing and/or retrieving one or more sampling bottles or vessels from the sampling circuit and/or the sampling apparatus.

The sampling bottles or vessels may be disposed in a collection module, which may be removable and/or retrievable from a part of the sampling apparatus.

The method may comprise partially closing the flow control valve to create a pressure differential sufficient to create a turbulent and/or mixed flow of fluid in the sampling circuit.

The flow control valve may be a first flow control valve, and the sampling apparatus may comprise a second flow control valve. Where a second flow control valve is provided, the method may comprise regulating the flow of fluid through and/or into the sampling circuit. The method may comprise choking the flow through sampling circuit.

Thus the method may comprise partially closing the flow control valve to create a pressure differential in excess of that required or desired to drive a sufficient portion of fluid passing through the sampling apparatus into the sampling circuit, in order to create a turbulent and/or mixed flow of fluid in the sampling circuit. The second flow valve regulates the turbulent and/or mixed flow of fluid back to the required flow rate for sampling of the fluid.

The sampling apparatus may comprise a further flow control valve. Where a further flow control valve is provided, the method may comprise regulating the flow of fluid through the sampling circuit using the second flow control valve and/or the further flow control valve.

The method may comprise partially closing the second flow valve and/or the further flow control valve to regulate a turbulent and/or mixed flow of fluid back to the required flow rate for sampling of the fluid.

Embodiments of the fourth aspect of the invention may include one or more features of the first to third aspects of the invention or their embodiments, or vice versa.

According to a fifth aspect of the invention there is provided a valve apparatus, the valve apparatus comprising:

an inlet;

an outlet;

a flow control valve disposed between the inlet and the outlet;

a first flow line in communication with a sampling circuit, the first flow line disposed between the inlet and the flow control valve;

a second flow line in communication with a sampling circuit, the second flow line disposed between the outlet and the flow control valve;

wherein the flow control valve is operable to drive a fluid into the sampling circuit.

Embodiments of the fifth aspect of the invention may include one or more features of the first to fourth aspects of the invention or their embodiments, or vice versa.

According to a sixth aspect of the invention, there is provided a method of sampling fluid from a flow system, the method comprising:

providing a sampling circuit;

providing a valve apparatus comprising:

an inlet, an outlet;

first and second flow lines in communication with the sampling circuit; and a flow control valve;

using the flow control valve of the valve apparatus to drive a fluid into the sampling circuit.

The method may comprise partially closing the flow control valve to create a pressure differential between the first and second flow lines, and thereby drive a fluid into the sampling circuit.

Embodiments of the sixth aspect of the invention may include one or more features of the first to fifth aspects of the invention or their embodiments, or vice versa.

According to a seventh aspect of the invention, there is provided a flow system in a subsea oil and gas production installation comprising the valve apparatus of the first, second or fifth aspects of the invention The flow system may comprise a sampling apparatus having one or more sampling bottles or vessels.

The flow system may comprise a sampling apparatus having one or more sampling bottles or vessels which are removable and/or retrievable from a part of the sampling apparatus.

The sampling bottles or vessels may be disposed in a collection module, which may be removable and/or retrievable from a part of the sampling apparatus.

Embodiments of the seventh aspect of the invention may include one or more features of the first to sixth aspects of the invention or their embodiments, or vice versa.

According to a further aspect of the invention, there is provided a valve apparatus for a flow system in a subsea oil and gas production installation substantially as described herein with reference to the appended drawings.

According to a further aspect of the invention, there is provided a method of sampling fluid from a flow system in a subsea oil and gas installation substantially as described herein with reference to the appended drawings.

DETAILED DESCRIPTION OF PREFERRED EMBODIMENTS

Figure 1:
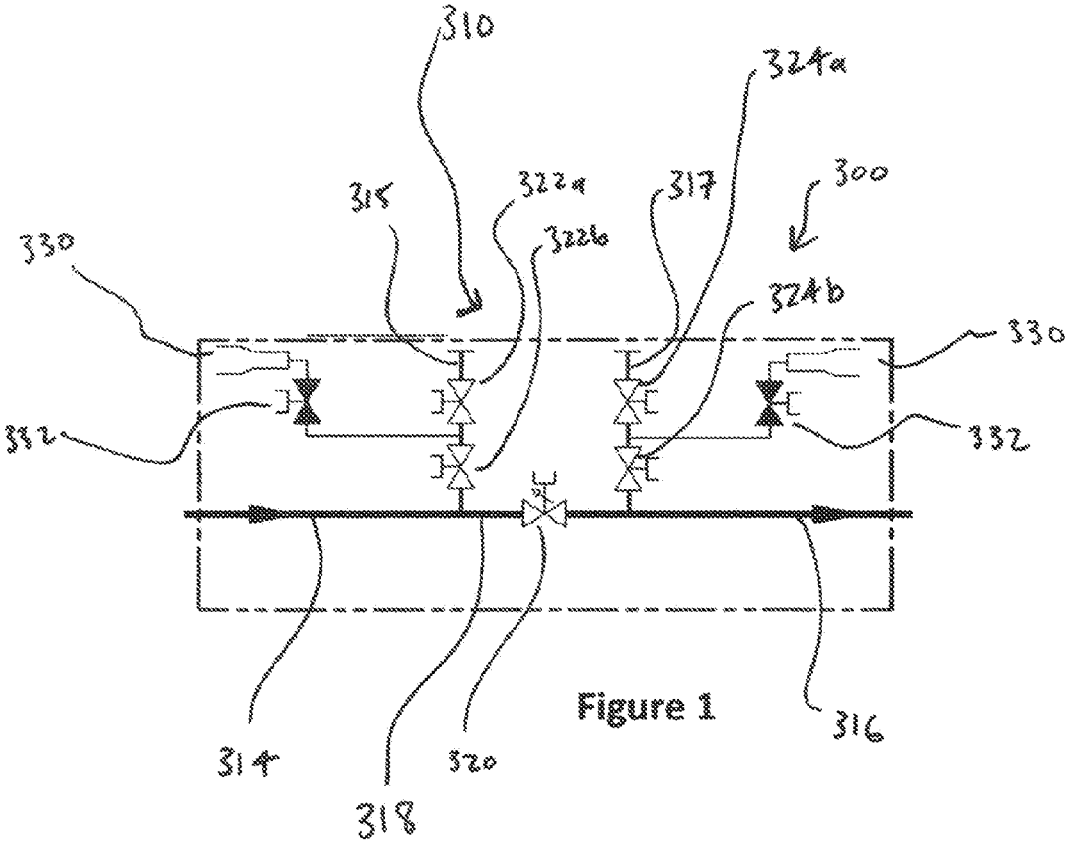
FIG. 1 is a process and instrumentation diagram showing schematically the features of a valve apparatus according to a first embodiment of the invention.

Referring firstly to FIG. 1, there is shown a valve apparatus according to a first embodiment of the invention. The valve apparatus, generally depicted at 300, is designed to be in conjunction with a subsea production system (not shown) and provides a flow access interface 310 to the subsea production system. In this embodiment, the valve apparatus comprises a first flow bore 314, a second flow bore 316, and first and second flow access bores 315, 317. The first and second flow bores 314, 316 are in fluid communication with the subsea production system. Disposed between the first and second flow bores 314, 316 is a bypass bore 318 comprising a flow control valve 320.

The flow access bores 315, 317 extend from the interface 310 to the flow bores 314, 316 and provide a fluid intervention path between the interface and the production system to which the valve apparatus is connected. In each of the flow access bores 315, 317 there is located a pair of isolation valves 322*a*, 322*b* and 324*a*, 324*b*, respectively. In this case, the isolation valves 322*a*, 322*b*, 324*a*, 324*b* are ROV operated isolation valves and enable the flow access bores 315, 317 and flowlines 314, 316 to be isolated, for example, during connection and disconnection of equipment to the interface 310. ROV hot stab connectors 330 and associated ROV operated valves 332 are connected to each of the flow access bores 315, 317 between their respective isolation valves 322*a*, 322*b*, 324*a*, 324*b*. Together, the hot stabs 330 and valves 332 enable controlled provision of hydraulic or system fluids, for example for the flushing of internal lines.

The valve apparatus 300 is configured to be used in a subsea production system in a number of different configurations, as will be apparent from the following description. In a production mode, production flow is received into the flow bore 314, is directed through the bypass bore 318 through the flow control valve 320 in its open condition, and is directed out of the flow bore 316. The flow access bores 315, 317 facilitate a range of fluid intervention operations and the benefits of the invention and its features will be illustrated with reference to the exemplary implementations described below.

Figure 2:
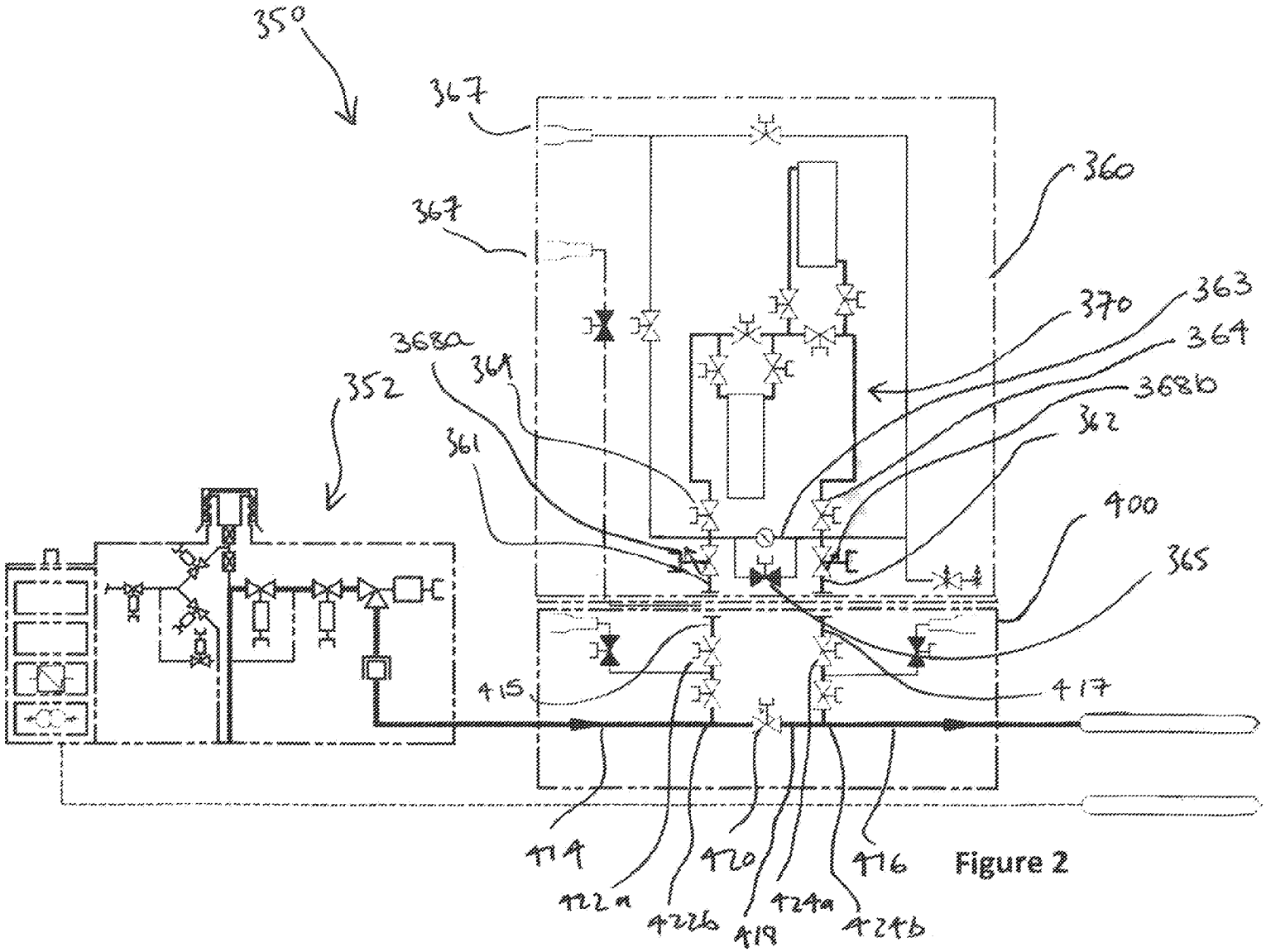
FIG. 2 is a process and instrumentation diagram showing schematically a subsea production flow system incorporating the valve apparatus of FIG. 1 in a sampling application.

Referring now to FIG. 2, there is shown generally at 350, a subsea production flow system incorporating the valve apparatus of an embodiment of the invention in a sampling application. The valve apparatus 400 is the same as the valve apparatus 300, and will be understood from FIG. 1 and the accompanying description, with like features labelled with like reference numerals incremented by 100. In this embodiment, the valve apparatus 400 is a flowline enabled valve, configured to be connected into a production flowline between a subsea tree 352 and a production manifold (not shown). The valve apparatus 400 is in fluid communication with a flowline from the production wing of the subsea tree, such that production fluid enters the first flow bore 414. The second flow bore 416 is connected to a flowline which leads to a production manifold. In this embodiment, the flow control valve 420 is a gate valve.

In this embodiment, the flow access interface of the valve apparatus 400 is connected to a sampling apparatus, generally depicted at 360. The sampling apparatus comprises a pair of flowlines 361, 362 connected respectively to the flow access bores 415, 417 of the valve apparatus. Sampling isolation valves 364 and valves 368*a*, 368*b* are provided in the flowlines 361, 362. The flowlines 361, 362 respectively provide an inlet and an outlet to a sampling circuit, generally depicted at 370. In this case, the sampling circuit contains a pair of sampling bottles which are connected into the sampling circuit via ROV operated isolation valves. A first bottle is arranged with its sampling volume substantially vertically below the sampling flowline, to facilitate collection of liquid phase hydrocarbons. Gaseous phase hydrocarbons tend to pass and are collected in the second sampling bottle, which is arranged substantially above the flowline.

A bypass line 363 connects first and second flowlines and is provided with a pressure gauge and a ROV actuated valve 365. The ROV actuated valve 365, in conjunction with the sampling isolation valves 364 and valves 368*a*, 368*b*, enable fluid entering the sampling apparatus to be bypassed from the sampling circuit if required. ROV hot stab connectors 367 are provided on the sampling module along with ROV operated valves, and together the hot stabs and valves enable controlled delivery of hydraulic or system fluids, for example for flushing of the sampling circuit and/or flowlines.

In a production mode, isolation valves 422*b*, 424*b* and optionally isolation valves 422*a* and 424*a* are closed. The flow control valve 420 is fully open such that production fluid flows through the bypass bore 418, and exits the valve apparatus 400 through the second flow bore 416 to a flowline towards the production manifold.

In sampling mode, the flow control valve 420 is operated to initiate sampling. With the isolation valves 422, 424 open, the sampling isolation valves 364 open, and valves 368*a*, 368*b* also open, the flow control valve 420 is partially closed such that the valve member (in this case, the valve gate) partially impinges into the production flow. This flow disruption creates a hydrodynamic pressure differential between the flow access bores 415, 417 which is sufficient to drive fluid from the first flow bore into the flowline of the sampling apparatus.

The inventors have appreciated that only a small pressure differential, of the order of 1 bar (0.1 MPa) is desirable in order to drive the sampling circuit without creating excessive flow of the fluid into the sampling bottles. By use of a flow control valve, the pressure differential can be adjusted by using an ROV (or in shallow water, a diver) to control the extent to which the valve is used to create a flow restriction. This simple adjustability means that the valve position can be modified to maintain the desired pressure differential in a range of different flow conditions. The control provided by the valve adjustment enables the pressure differential to be optimised to the production flow. In particular, the valve position can be adjusted in dependence on the flow rate to ensure that the pressure differential of the right magnitude can be selected regardless of the flow rate. Therefore, adjustment can be performed by the ROV to enable sampling at different stages of production, in which production rates differ markedly. The ability to maintain a small pressure differential facilitates application to a wide range of flow regimes, including for example wet gas production wells.

The flow control valve can be a conventional flow control valve of the type commonly used in subsea applications, which are readily available, have known reliability, and which are easily adjusted with conventional subsea tools.

It will be appreciated that the valve apparatus, while providing particular advantages in sampling applications, may also be used for alternative flow access applications.

Figure 3:
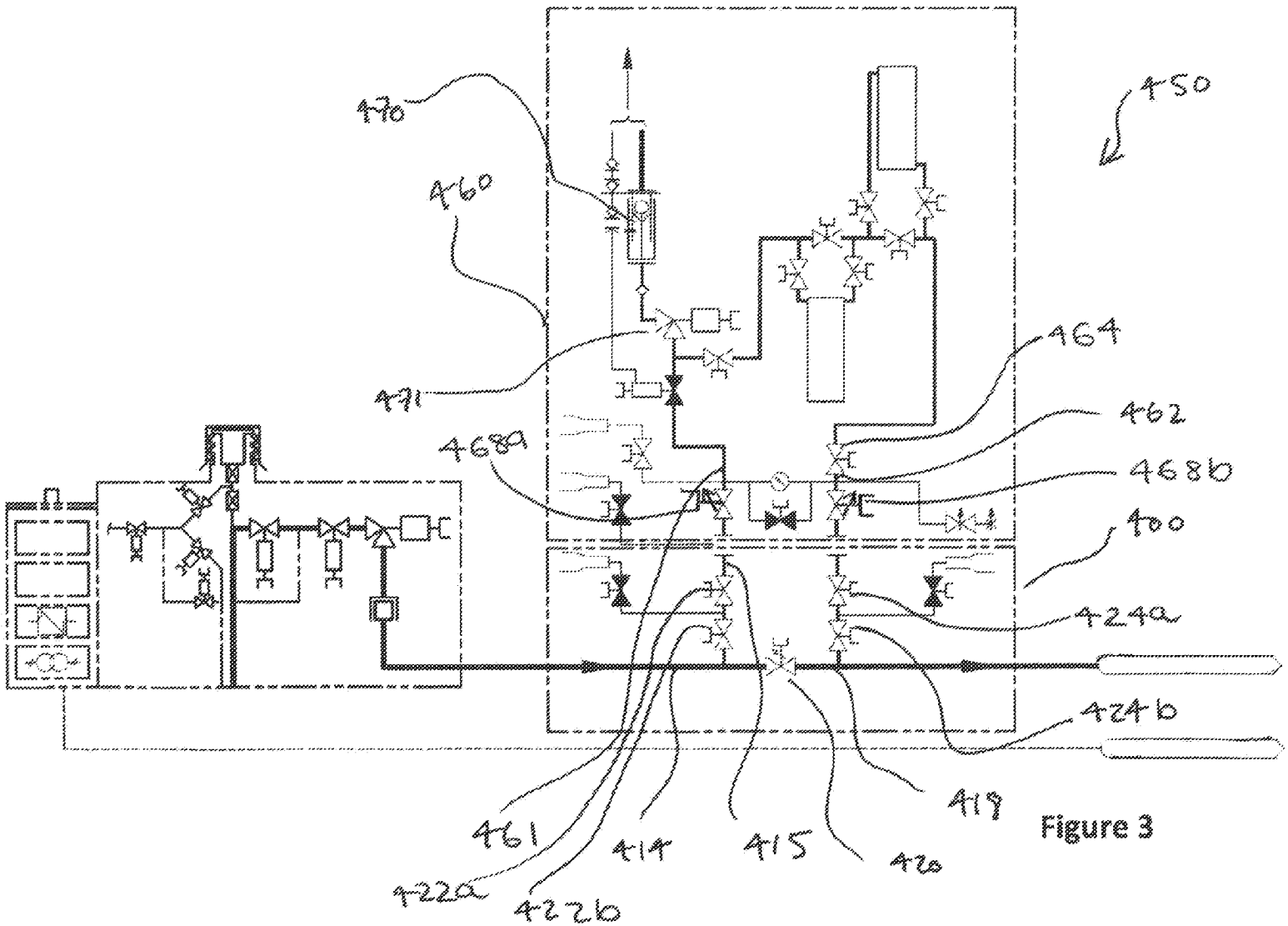
FIG. 3 is a process and instrumentation diagram showing schematically a subsea production flow system incorporating the valve apparatus of FIG. 1 in a combined sampling and injection application.

Referring now to FIG. 3, there is shown a valve apparatus installed in a subsea production system applied to a sampling and injection application. In this embodiment, the valve apparatus 400 is the same as the valve apparatus 400 of FIG. 2, and is connected into the production flowline between a subsea tree and the production manifolds. However, in this case, the flow access interface of the valve apparatus is connected to a combined sampling and injection apparatus, generally shown at 460. The apparatus 460 is similar to the apparatus 360, and the sampling functionality will be understood from FIG. 2 and the accompanying description. However, the apparatus 460 comprises an injection hose termination device 470 connected to the flowline 461 via an injection flow control valve 471. In use, the system 450 enables a subsea injection operation, and in particular a well scale and squeeze operation, to be performed. Injection fluid can be delivered from a hose to the production bore via the flowline 461, the flow access bore 415, and the flow line 414. Injection fluid is prevented from passing into the flow line 416 by isolation valves in the flowline 462 and the flow control valve 420 in the bypass line 418. After the operation is complete, the hose termination can be removed and the flow of production fluid can be resumed with the apparatus 460 still in place, by closing valves 422*a*, 422*b*, 424*a*, 424*b* and opening valve 420.

Figure 4:
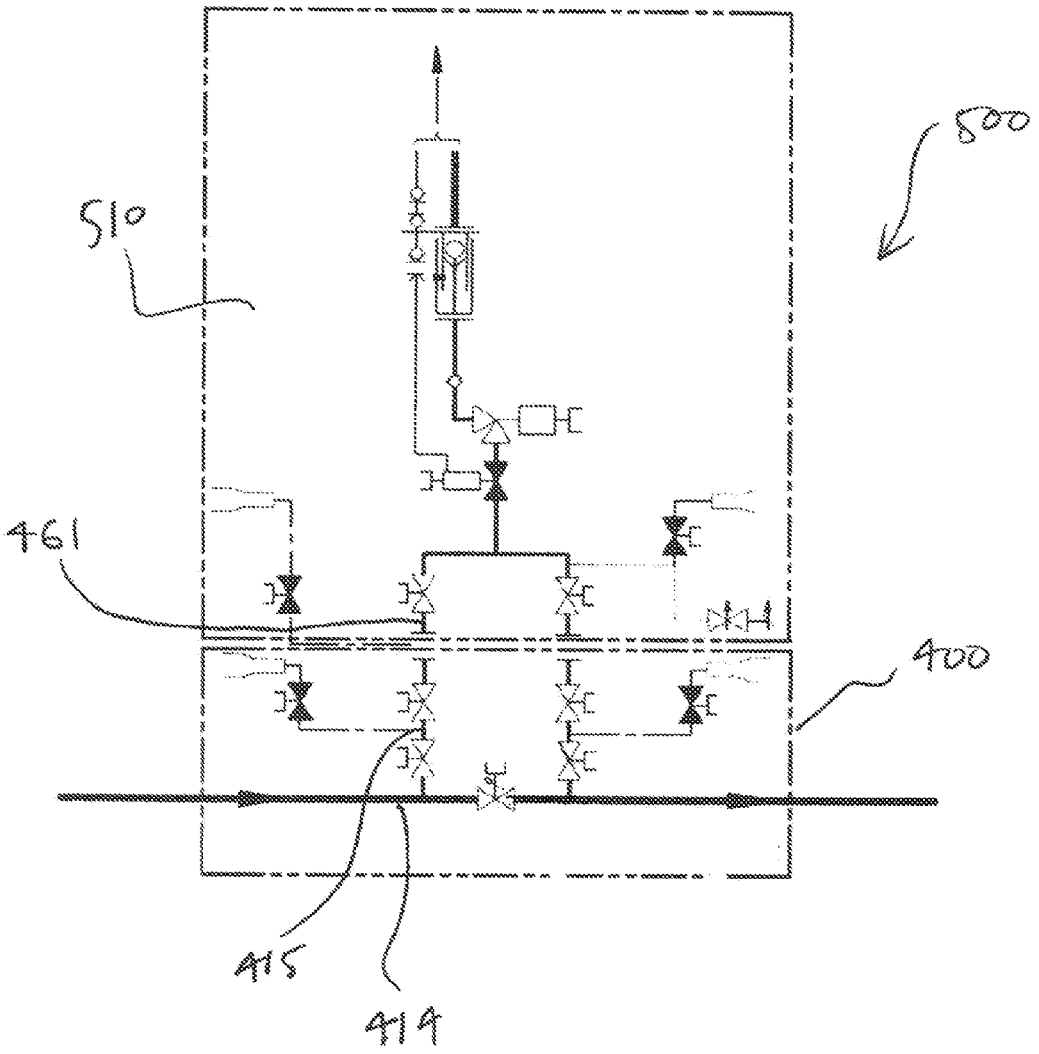
FIG. 4 is a process and instrumentation diagram showing schematically a subsea production flow system incorporating the valve apparatus of FIG. 1 in an injection application.

Referring now to FIG. 4, there is shown a valve apparatus 400 installed in a subsea production system 500 in a flowline between a subsea tree and a production manifold (neither shown). In this embodiment, the valve apparatus provides a flow access point for an injection apparatus 510. The system 500 enables a subsea injection operation, and in particular a well scale and squeeze operation, to be performed by delivering injection fluid from a hose to the production bore via the flowline 461, the flow access bore 415, and the flow bore 414.

Figure 5:
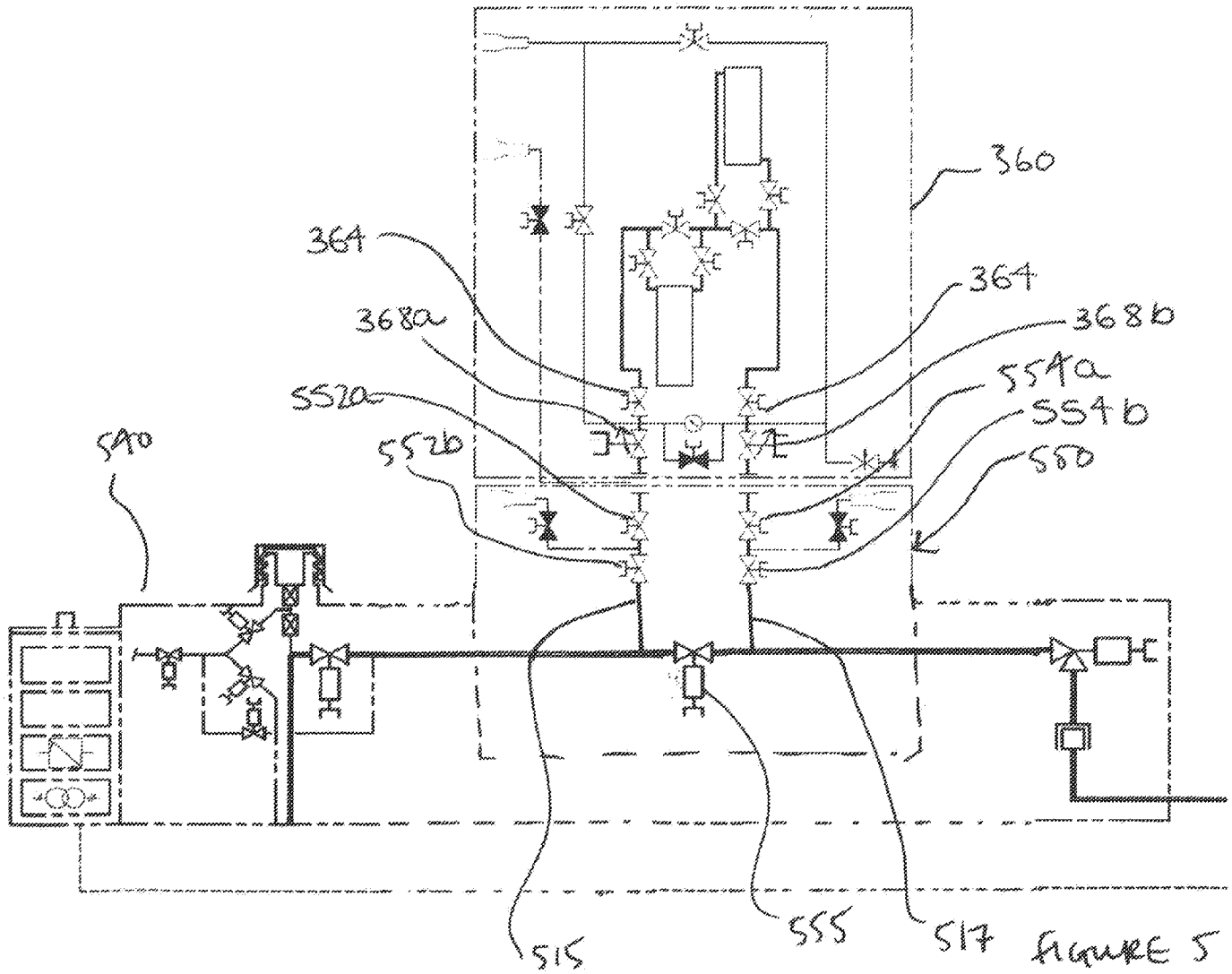
FIG. 5 is a process and instrumentation diagram of a subsea tree incorporating a valve apparatus according to an embodiment of the invention in a subsea sampling application.

In the foregoing embodiments, the valve apparatus 400 is configured to be connected into a flowline such as a jumper flowline in the production flow system, downstream of the subsea tree and upstream of the production manifold. However, it will be appreciated that the invention may also be implemented in a valve apparatus which forms a part of a subsea tree itself. Referring now to FIG. 5, there is shown an example embodiment of the invention in which the valve apparatus is integrated into a modified production wing valve, generally shown at 550. The apparatus 550 is similar to the apparatus 300 and 400, and will be understood from FIGS. 1, 2 and 3 and the accompanying description.

However, the valve apparatus is directly mounted into the subsea tree 540, and provides a flow access interface at the production wing of the tree, in this case to a sampling apparatus 360.

In a normal production mode, the valve apparatus 550 functions as a conventional production wing valve, with the isolation valves 552*a*, 552*b*, 554*a*, 554*b* closed. However, the production wing valve 555 can also be operated to initiate sampling. With the isolation valves 552*a*, 552*b*, 554*a*, 554*b* open, the sampling isolation valves 364 open, and valves 368*a*, 368*b* also open, the valve 555 is partially closed such that the valve member (in this case, the valve gate) partially impinges into the production flow. This flow disruption creates a hydrodynamic pressure differential between the flow access bores 515, 517 which is sufficient to drive fluid from the first flow bore into the flowline of the sampling apparatus.

It will be appreciated that although the described embodiment is a modified production wing valve, other valves which form a part of a conventional or horizontal subsea tree may be used to form a sampling drive valve and flow access interface, including any suitable production or annulus master or wing valve. In further alternative embodiments, any suitable valve forming a part of a subsea collection manifold system; a subsea Pipe Line End Manifold (PLEM); a subsea Pipe Line End Termination (PLET); and/or a subsea Flow Line End Termination (FLET) may be used to form a sampling drive valve and flow access interface in accordance with principles of the invention.

Figure 6:
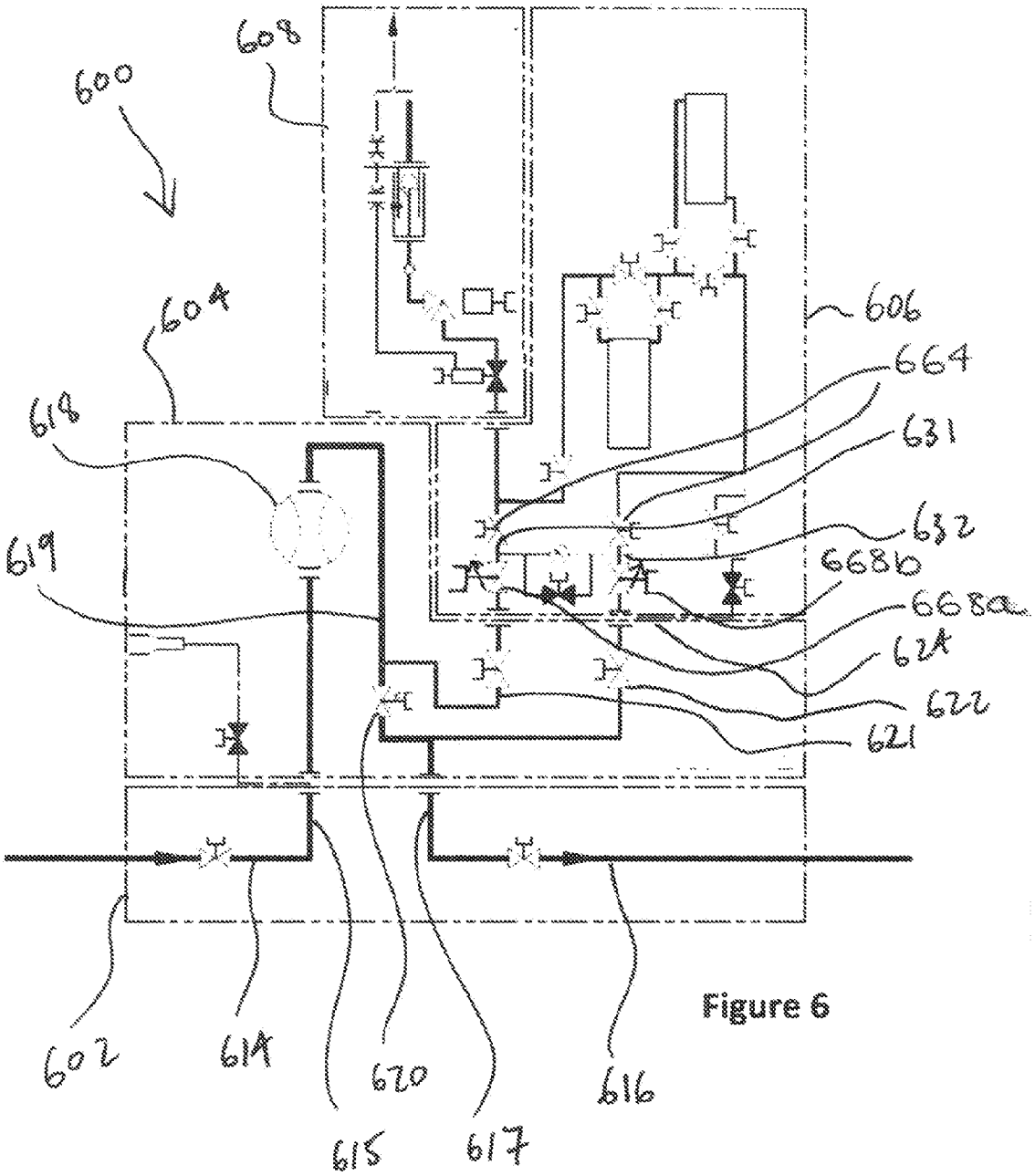
FIG. 6 is a process and instrumentation diagram of a subsea production flow system in accordance with an alternative embodiment of the invention, comprising a valve apparatus integrated into a multiphase flow meter module in a combined injection and sampling application.
Figure 7:
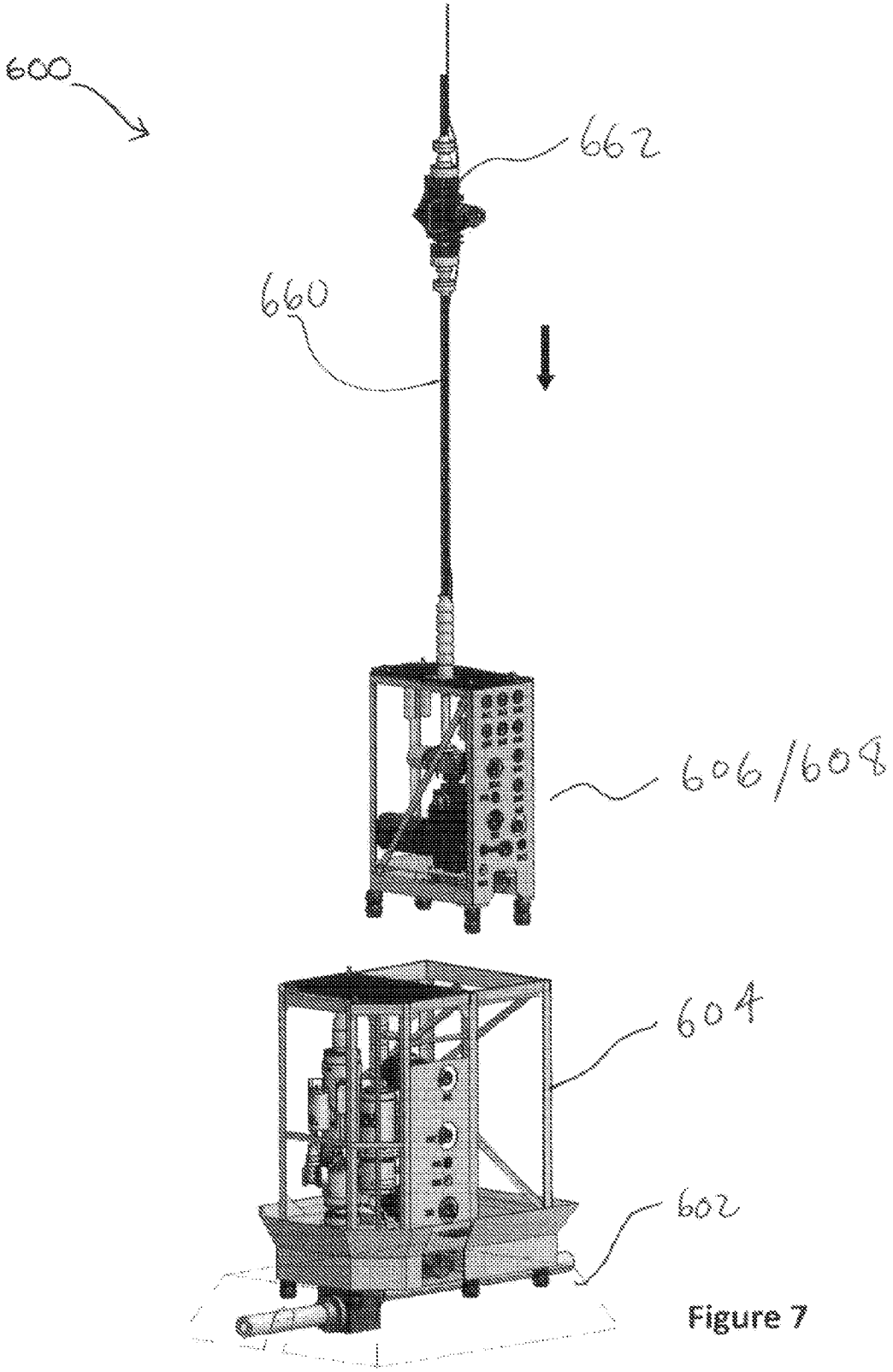
FIG. 7 is an isometric view of the system of FIG. 6 during installation on a subsea flow access point.
Figure 8:
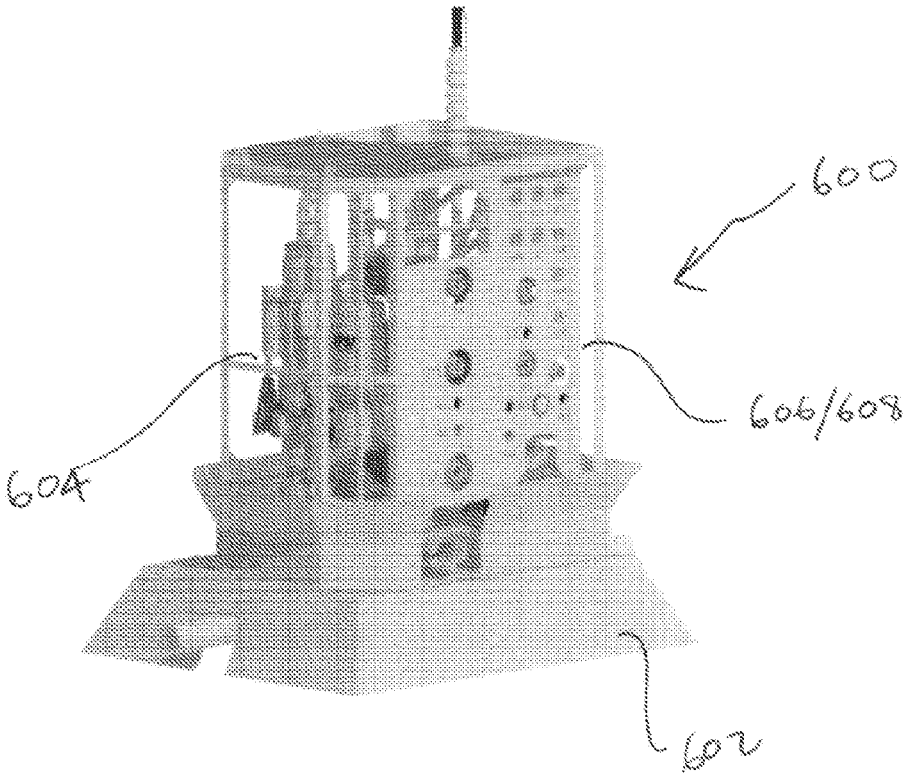
FIG. 8 is an isometric view of the system of FIG. 7 after installation.

Referring now to FIGS. 6, 7, and 8, there is shown an alternative embodiment of the invention in which a valve apparatus is incorporated into a functional subsea apparatus, which in this case is a multiphase flowmeter module. FIG. 6 shows a system, generally depicted at 600, comprising a flow access interface module 602, a multiphase flowmeter module 604, a sampling module 606, and an injection module 608. The flow access interface module provides dual bore access to the subsea production flow system via flow bores 614, 616. Flow access bore 615 connects the production flow to the multiphase flowmeter 618, and flowline 619 returns production fluid to the access bore 617 via flow control valve 620. The flowline 619 is in this embodiment a full bore flowline, formed to the same inner diameter as the bores of the flow access module (for example, 5 inches (about 125 mm)). The flow control valve 620, which is also a full bore valve, is disposed between sampling flowlines 621, 622, leading to an upper module interface 624. Connected to the upper module interface 624 is the sampling module 606. The module 606 is functionally similar to the sampling apparatus 360 described in previous embodiments, but is configured as a module for attachment to a modular interface. Sampling flowlines 631, 632 connect to the flowlines 621, 622, and lead to a sampling circuit.

In a metering mode, production flow is passed through the flowline 619 and flowmeter 618 and returned to the production flowline 616 via the open valve 620. However, in a sampling mode, the valve 620 is operated to initiate sampling: the valve 620 is partially closed such that the valve member (in this case, the valve gate) partially impinges into the production flow. This flow disruption creates a hydrodynamic pressure differential between the flowlines 621, 622 which is sufficient to drive fluid from the flowline 619 into the sampling circuit of the module 606.

Injection module 608 enables a subsea injection operation, and in particular a well scale and squeeze operation, to be performed by delivering injection fluid from a hose to the production bore via the sampling flowline 631, the flowline 619, and the flow bore 614. It will be appreciated that in an alternative embodiment, the injection and sampling functions of the system may be performed by a single, combined injection and sampling module, rather than the two separate modules shown in FIG. 6.

In addition to the primary flow control valves, which function to drive fluid into a sampling circuit, the foregoing embodiments comprise additional valves for additional flow control, the operation of which will be described with reference to FIG. 2. In the sampling apparatus 360 of FIG. 2, there is provided a pair of valves 368*a*, 368*b*. The inclusion of the valves 368*a*, 368*b* facilitates the mixing of multiphase fluid flow prior to its entry into the sampling circuit 370. In a sampling mode, the flow control valve 420 is partially closed with the isolation valves 422*a*, 422*b*, 424*a*, 424*b* and the sampling isolation valves 364 open. The partially closed flow control valve 420 creates a flow restriction which produces a pressure differential between the flow access bores 415, 417. Although only a small pressure differential, of the order of 1 bar (0.1 MPa), may be required to drive the desired proportion of fluid through the sampling circuit, in certain applications the fluid entering the sampling circuit may be unrepresentative of the fluid. In particular, when a multiphase fluid contains fluids of various densities, flow regimes may develop which may not provide a representative sample of the fluid.

In some modes of operation, the flow control valve 420 may be partially closed to create an increased pressure differential, greater than that required or desired to drive a sufficient portion of fluid into the sampling circuit. This pressure differential produces a turbulent and/or mixed flow on the inlet side of sampling circuit 370. Valves 368*a*, 368*b*, or both, are adjusted to provide a restriction which regulates the fluid flow passing into the sampling circuit 370, and returns the flow to a desired sampling flowrate. Therefore, valves 420, 368*a* and 368*b* may be operated together to enable mixing of the fluid before it enters the main portion of the sampling circuit 370, and then regulating the resulting flow to a desired rate. The combination of valve 420 with valves 368*a* and/or 368*b* mitigates the unrepresentative sampling which could occur if an unmixed and unrepresentative flow regime were to enter the sampling bottles.

The flow control valves 368*a*, 368*b* may be conventional flow control valves of the type commonly used in subsea applications, which are readily available, have known reliability, and which are easily adjusted with conventional subsea tools. It will be appreciated that valves 368*a*, 368*b* may not be present in an application where flow mixing is not required. It will also be appreciated that only one of the valves 368*a*, 368*b* may be provided.

The embodiments described with reference to FIGS. 3, 5 and 6 also comprise additional flow control valves to regulate the flow rate of an induced turbulent or mixed flow to a preferred sampling rate. In FIG. 3, a pair of valves 468*a*, 468*b* is provided. The additional flow control valves of the embodiment of FIG. 5 are 368*a* and 368*b*, and in FIG. 6 are shown at 668*a* and 668*b*. In each case, the additional flow control valves are similar to the valves 368*a*, 368*b* of apparatus 360 and their functionality will be understood from FIG. 2 and the foregoing description.

FIG. 7 is an isometric view of the modules of the system 600 being installed, and FIG. 8 is an isometric view of the installed system. The module 602 is installed in the existing subsea infrastructure. Metering module 604 is lowered by a launch and recovery system and landed with the assistance of an ROV. Each module is provided with feet to enable them to be softly landed on the existing structure or module. In this embodiment, the sampling and injection modules 606/608 are shown combined and are landed together into the metering module. An injection hose 660 is coupled to an injection umbilical via a weak link connector 662.

Figure 9:
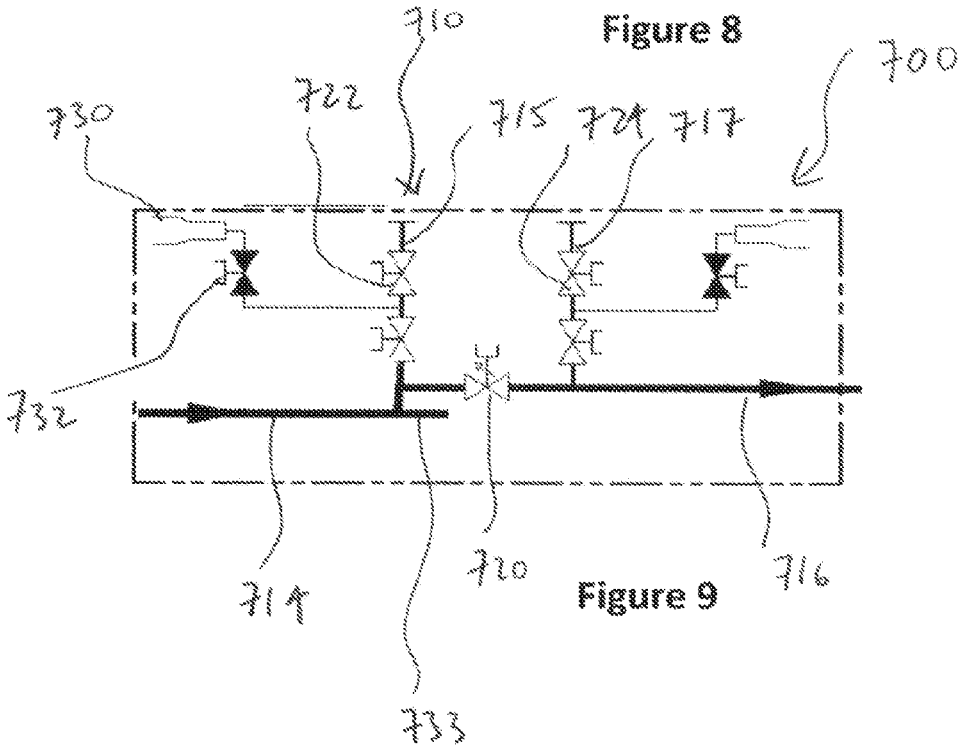
FIG. 9 is a process and instrumentation diagram of a valve apparatus according to an alternative embodiment of the invention, configured as a flow access interface.

Referring now to FIG. 9, there is shown a process and instrumentation diagram of a valve apparatus according to an alternative embodiment of the invention. The valve apparatus of this embodiment is implemented in a flow access interface module, which in this case forms a part of a system of functional subsea modules. The apparatus, generally depicted at 700 is similar to the apparatus 300, with like parts labelled with like reference numbers incremented by 400. The first flow bore also defines a blind mixing tee 733 which extends into the body from the first connector. The mixing tee 733 facilitates mixing of a multiphase production fluid before it passes into the process equipment through the flow access interface 710.

Figure 10:
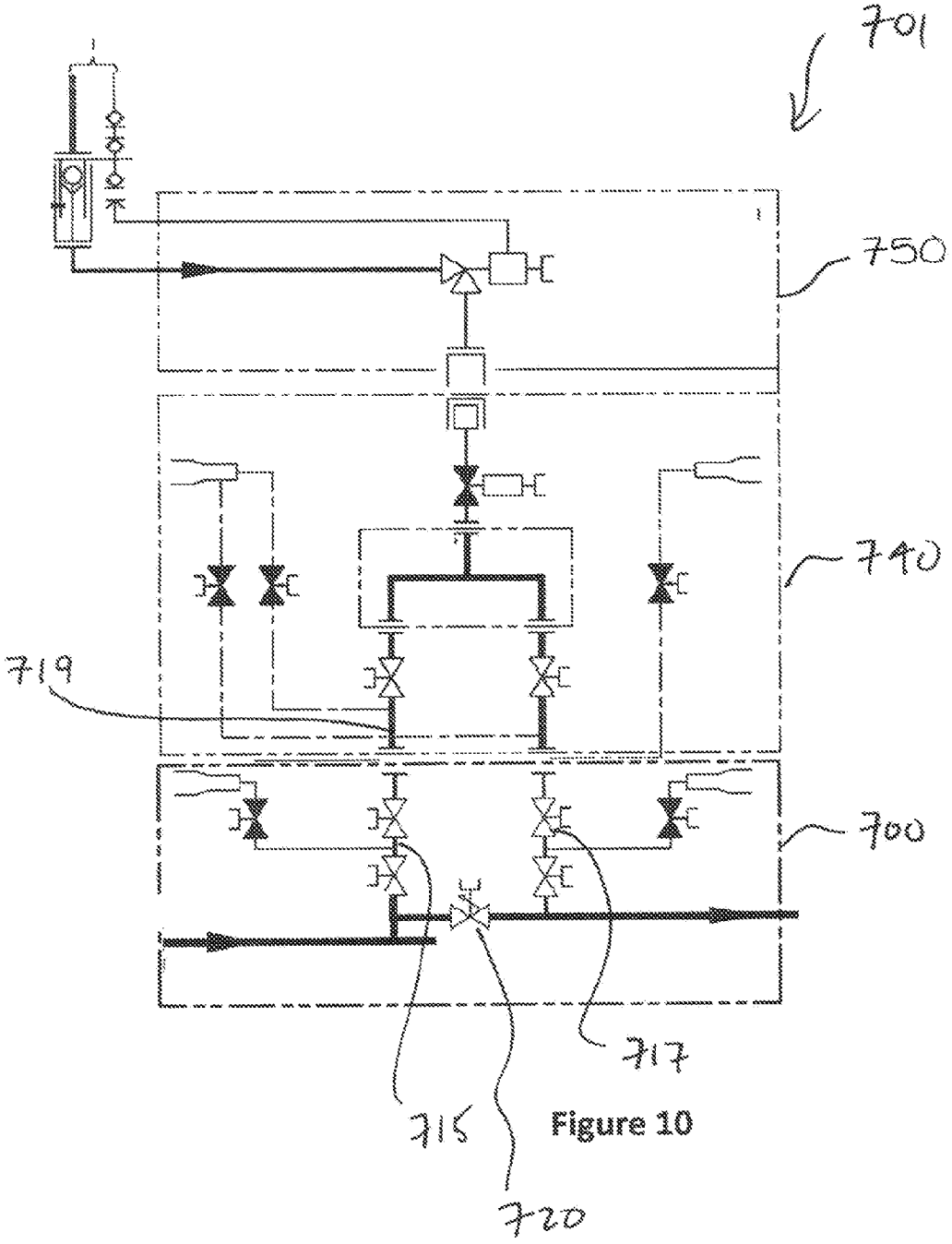
FIG. 10 is a process and instrumentation diagram of a modular system mounted on the valve apparatus of FIG. 9, in a combined injection and sampling application.

FIG. 10 shows the apparatus 700 as part of a sampling and injection system 701, formed from a sampling module 740 and an injection module 750. In a sampling mode, the flow control valve 720 of the valve apparatus is operated to initiate sampling by partially closing the valve such that the valve member (in this case, the valve gate) partially impinges into the production flow. This flow disruption creates a hydrodynamic pressure differential between the flow access bores 715, 717 which is sufficient to drive fluid from the flowline 719 into the sampling circuit of the module 740.

Figure 11:
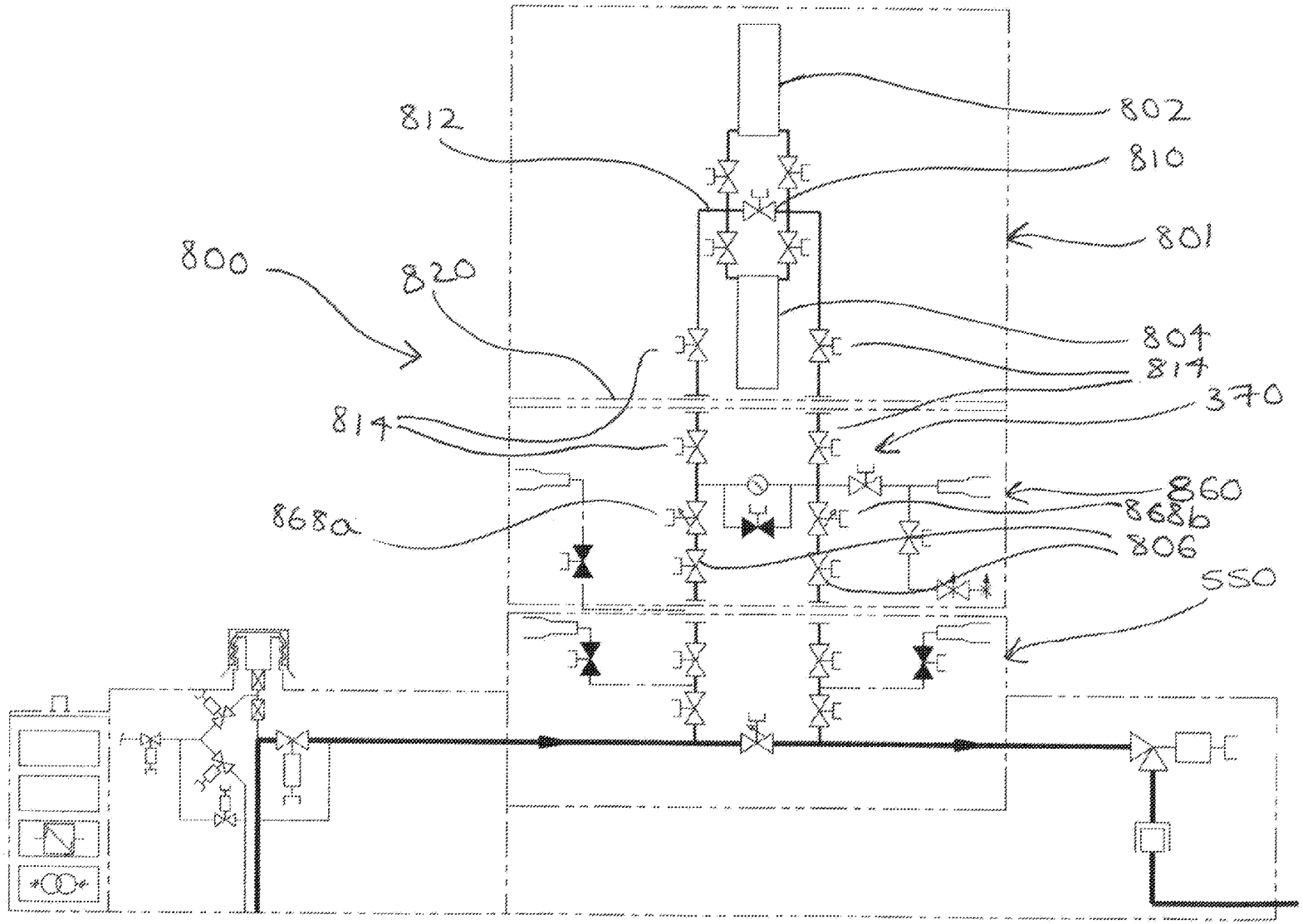
FIG. 11 is a process and instrument diagram of a subsea tree incorporating a valve apparatus according to an embodiment of the invention in a subsea sampling application.

Referring now to FIG. 11, there is shown a valve apparatus and sampling system according to an alternative embodiment of the invention. In this embodiment, the valve apparatus is the same as the valve apparatus 550, and is integrated into a modified production wing valve. The sampling system 800 is similar in function to the sampling apparatus 360 and will be understood from FIG. 5 and the accompanying description. However, in this case, the sampling system 800 is formed from a primary sampling module 860 and a separate, retrievable collection module 801, which is connected to the primary sampling module 860 by an interface 820. Isolation valves 814 enable the collection module 801 and sampling bottles 802, 804 to be isolated from the remainder of the system. In this embodiment, isolation valves 806 are disposed below the flow control valves 868*a*, 868*b*, so that they are placed as close to the interface between the primary sampling module 860 and the valve apparatus 550.

The retrievable collection module 801 contains upper and lower sampling bottles 802, 804. In contrast with previous embodiments, the sampling bottles 802, 804 are configured such that the inlet and the outlet flowlines of each sampling bottle are disposed on either side of a single valve 810, respectively above and below the sampling flowline 812. The inlet and the outlet of upper bottle 802 are placed at the same height. The vertically displaced configuration of upper and lower sampling bottles 802, 804 respectively within collection module 801 may facilitate the preferential collection of liquid phase hydrocarbons in lower bottle 804, whilst gaseous phase hydrocarbons are preferentially collected in the upper sampling bottle 802. This configuration may therefore aid separation during sampling.

The separable nature of the collection module 801 from the primary sampling module 860 enables sampling bottles 802, 804 to be retrieved to surface or changed out for replacement bottles without retrieving the sampling system as a whole.

Figure 12:
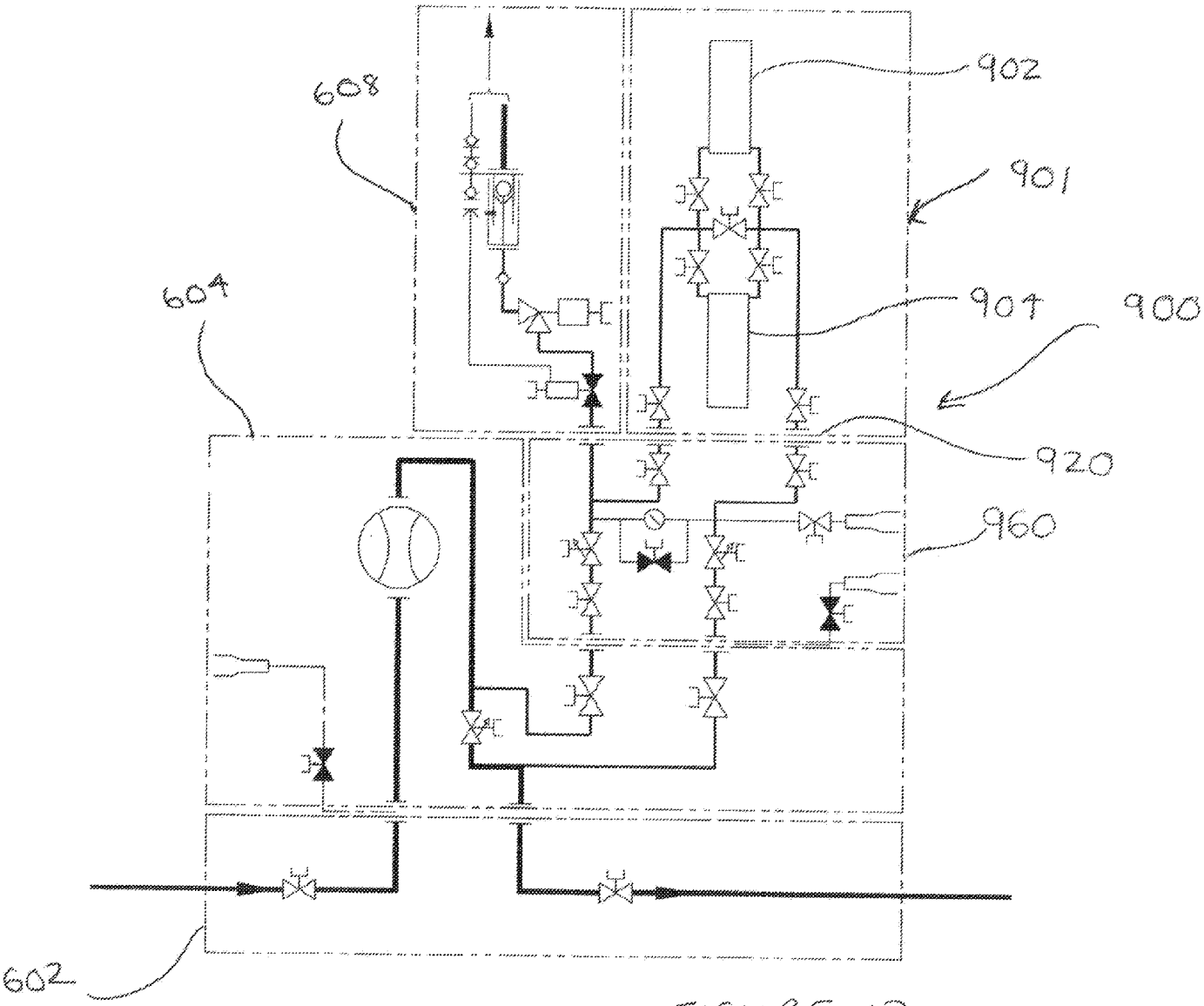
FIG. 12 is a process and instrumentation diagram of a subsea production flow system in accordance with an alternative embodiment of the invention, comprising a valve apparatus integrated into a multiphase flow meter module in a combined injection and sampling application.

It will be appreciated that one or more separable, retrievable, sampling bottles or vessels may be used in alternative configurations, in other embodiments of the invention. An example of such a system is shown in FIG. 12. In this embodiment, the sampling system 900 is similar the sampling system 606, and will be understood from FIG. 6 and the accompanying description. Similarly to the system 800, the sampling system 900 is formed from a primary sampling module 960 and a separate, retrievable collection module 901, which is connected to the primary sampling module 960 by an interface 920. However, in this case, the collection module 901 is connected to the primary sampling module 960 in parallel with the injection module 608. The separable nature of the collection module 901 from the primary sampling module 960 enables sampling bottles 902, 904 to be retrieved to surface or changed out for replacement bottles without retrieving the sampling system as a whole.

It will be appreciated that valve types other than gate valves may be used in alternative embodiments of the invention, including (for example) ball valves.

The invention provides a valve apparatus for a flow system in a subsea oil and gas production installation and a method of use. The valve apparatus comprises an inlet for production flow from the subsea oil and gas production installation, an outlet for production flow, and a flow control valve disposed between the inlet and the outlet. A first flow line in communication with a sampling circuit is disposed between the inlet and the flow control valve, and a second flow line in communication with a sampling circuit is disposed between the outlet and the flow control valve. The flow control valve is operable to be partially closed to create a pressure differential between the first and second flow lines, and thereby drive a production fluid into the sampling circuit.

Embodiments of the invention provide a range of flow access solutions which facilitate convenient intervention operations. These include fluid introduction for well scale squeeze operations, well kill, hydrate remediation, and/or hydrate/debris blockage removal; fluid removal for well fluid sampling and/or well fluid redirection; and/or the addition of instrumentation for monitoring pressure, temperature, flow rate, fluid composition, erosion and/or corrosion. Other applications are also within the scope of the invention.

It will be appreciated that the invention facilitates access to the flow system in a wide range of locations. These include locations at or on the tree, including on a tree or mandrel cap, adjacent the choke body, or immediately adjacent the tree between a flow line connector or a jumper. Alternatively, the apparatus of the invention may be used in locations disposed further away from the tree. These include (but are not limited to) downstream of a jumper flow line or a section of a jumper flow line; a subsea collection manifold system; a subsea Pipe Line End Manifold (PLEM); a subsea Pipe Line End Termination (PLET); and/or a subsea Flow Line End Termination (FLET).

Various modifications may be made within the scope of the invention as herein intended, and embodiments of the invention may include combinations of features other than those

The invention claimed is:

1. A method of sampling fluid from a flow system in a subsea oil and gas installation, the method comprising:

providing a sampling circuit;

providing a valve apparatus comprising:

an inlet for production flow from the subsea oil and gas production installation, and an outlet for production flow;

a first flow control valve disposed between the inlet and the outlet;

first and second flow lines in communication with the sampling circuit and disposed between the inlet and the first flow control valve and the outlet and the first flow control valve, respectively; and a second flow control valve disposed in the first or second flow line;

partially closing the first flow control valve of the valve apparatus to create a pressure differential between the first and second flow lines and thereby create a turbulent and/or mixed flow of a production fluid and drive production fluid into the sampling circuit at a first flow rate; and partially closing the second flow control valve of the valve apparatus to regulate the turbulent and/or mixed flow of production fluid to a sampling flow rate through the sampling circuit, the sampling flow rate being less than the first flow rate.

2. The method according to claim 1, wherein the sampling circuit comprises one or more sampling bottles or vessels and wherein the method comprises collecting fluid in one or more sampling bottles or vessels.

3. The method according to claim 1, wherein the valve apparatus comprises a further flow control valve, and the method comprises regulating the flow of fluid through the sampling circuit using the second flow control valve and the further flow control valve.

4. The method according to claim 2, wherein the one or more sampling bottles or vessels comprises a sampling bottle or vessel arranged with its sampling volume substantially above a sampling flowline, and wherein the method comprises collecting gaseous phase hydrocarbons in the sampling bottle or vessel with its sampling volume substantially above the sampling flowline.

5. The method according to claim 2, wherein the one or more sampling bottles or vessels comprises a sampling bottle or vessel arranged with its sampling volume substantially below a sampling flowline, and wherein the method comprises collecting liquid phase hydrocarbons in the sampling bottle or vessel with its sampling volume substantially below the sampling flowline.

6. The method according to claim 2, wherein the one or more sampling bottles or vessels are removable and retrievable from the sampling circuit, and wherein the method comprises removing and/or retrieving the one or more sampling bottles or vessels from the sampling circuit.

7. The method according to claim 2, wherein the sampling bottles or vessels are disposed in a collection module, which is removable and/or retrievable from a part of the sampling circuit, and wherein the method comprises removing and/or retrieving the collection module.

8. The method according to claim 1, comprising coupling the valve apparatus into a production flowline located downstream of a subsea tree.

9. The method according to claim 1, comprising mounting the valve apparatus directly on to a subsea tree.

* * * * *